US009666923B2

(12) United States Patent
Louzir et al.

(10) Patent No.: US 9,666,923 B2
(45) Date of Patent: May 30, 2017

(54) FILTERING CIRCUIT WITH SLOT LINE RESONATORS

(71) Applicant: THOMSON LICENSING, Issy de Moulineaux (FR)

(72) Inventors: Ali Louzir, Rennes (FR); Chetan Joshi, Pin (IN); Jean-Luc Robert, Betton (FR)

(73) Assignee: THOMSON LICENSING, Issy-les-Moulineaux (FR)

( * ) Notice: Subject to any disclaimer, the term of this patent is extended or adjusted under 35 U.S.C. 154(b) by 124 days.

(21) Appl. No.: 14/669,699

(22) Filed: Mar. 26, 2015

(65) Prior Publication Data

US 2015/0280301 A1 Oct. 1, 2015

(30) Foreign Application Priority Data

Mar. 28, 2014 (FR) ..... 14 52718

(51) Int. Cl.
*H01P 3/08* (2006.01)
*H01P 1/201* (2006.01)

(52) U.S. Cl.
CPC ..... *H01P 1/2016* (2013.01)

(58) Field of Classification Search
CPC ..... H01P 1/2016; H01P 7/00; H01P 7/005; H01P 7/08
USPC ..... 333/202, 204, 219
See application file for complete search history.

(56) References Cited

U.S. PATENT DOCUMENTS

| | | | | |
|---|---|---|---|---|
| 5,539,420 | A | 7/1996 | Dusseux et al. | |
| 6,108,569 | A | 8/2000 | Shen | |
| 6,943,644 | B2 | 9/2005 | Hidaka et al. | |
| 7,369,010 | B2 * | 5/2008 | Alvarez | H01F 41/045 333/204 |

(Continued)

FOREIGN PATENT DOCUMENTS

| | | |
|---|---|---|
| CN | 102593568 | 7/2012 |
| CN | 103236571 | 8/2013 |

OTHER PUBLICATIONS

Chen etal—"A spirally complementary split-ring resonators antenna for circular polarization and RFID reader application"—Antennas and Propagation Society International Symposium (APSURSI), 2012 IEEE Jul. 8-14, 2012—p. 1.

(Continued)

*Primary Examiner* — Robert Pascal
*Assistant Examiner* — Kimberly Glenn
(74) *Attorney, Agent, or Firm* — Brian J. Dorini; Patricia A. Verlangieri

(57) ABSTRACT

The present invention relates to a filtering circuit comprising at least two slot line resonators arranged side by side and realized on a dielectric substrate having a first face equipped with a conductive layer and a second parallel face, each of said at least two resonators comprising a slot line etched in the conductive layer and folded according to a spiral pattern counting a plurality of turns, with a shape factor such that the slot line has parts noticeably parallel or concentric. According to embodiments of the invention, at least one turn of the spiral pattern of each of the resonators comprises at least one discontinuity, the discontinuities of said at least two slot line resonators being arranged in such a manner as to increase the electromagnetic coupling between said at least two slot line resonators.

13 Claims, 7 Drawing Sheets

(56) References Cited

U.S. PATENT DOCUMENTS

| | | | | |
|---|---|---|---|---|
| 2004/0257175 | A1 | 12/2004 | Hidaka et al. | |
| 2013/0187477 | A1 | 7/2013 | Nagai et al. | |
| 2016/0072168 | A1* | 3/2016 | Kawaguchi ..... | H01P 7/082 333/99 S |

OTHER PUBLICATIONS

Parkash etal—"Design of planar monopole antenna fed by asymmetric coplanar strip for WLAN applications"—2011 IEEE Indian Antenna Week (IAW 2011)—Dec. 18-22, 2011; pp. 1-4.
Alotaibi et al—"Novel folded waveguide resonator filter using slot technique"—IEEE Microwave and Wireless Components Letters—vol. 18; Issue 3; pp. 182-184—Mar. 2008.
Gheethan etal—"Broadband and Dual-Band Coplanar Folded-Slot Antennas (CFSAs)"—IEEE Antennas and Propagation Magazine; vol. 53; Issue1; pp. 80-89—Feb. 2011.
Lin etal—"Novel Patch-Via-Spiral Resonators for the Development of Miniaturized Bandpass Filters With Transmission Zeros"—Microwave Theory and Techniques, IEEE Transactions on vol. 55 , Issue 1—pp. 137-146—Jan. 2007.
Search Report Dated Nov. 18, 2014.

* cited by examiner

FILTERING CIRCUIT WITH SLOT LINE RESONATORS

This application claims the benefit, under 35 U.S.C. §119 of French Patent Application No. 1452718, filed Mar. 28, 2014.

TECHNICAL FIELD

The present invention relates to a filtering circuit with slot line resonators, more specifically a compact filtering circuit specially adapted to make selective filters on conventional single-layer or multi-layer substrates. The present invention also relates to band-pass filters including such circuits, these filters being adapted notably but not exclusively to wireless or mobile communication devices.

PRIOR ART

With the growing demand for new services, devices used for mobile communications and in home networks must be able to operate at different frequencies and according to several standards. In this case, it is necessary, in order to maintain the integrity of the signals corresponding to these different standards, to use very narrow-band filters constituted of high quality factor resonators.

In general, the implementation of such filters requires a compromise between on one hand the electrical performance of the filter and on the other hand its cost and size. The performance of a filter depends typically on the quality factor Q of the resonator used. The higher the quality factor, the better the performances of the filter. However, a high quality factor Q involves the use of technologies whose cost is high and the filters realised, for example SMD (surface mounted device) technology, are most often bulky, which is hardly compatible with the necessities of mobile devices.

Whereas, in the technology of printed circuits, resonators with microstrip lines are typically used, new slot line resonators have recently appeared for the manufacture of filters. The main advantage of these resonators is that it is very easy to integrate electronic components into them such as capacitors, resistors or varactors to control their quality factor Q or their resonant frequency. However, particular attention must be paid to radiation losses in slot structures. Moreover, their excitation from standard transmission lines on printed circuits such as microstrip or coplanar lines is not so simple.

Several of these spiral slot line resonators can be coupled for the design of low-cost and highly compact filters. But, the adjustment of the coupling of the resonators is not very simple and a high coupling of the resonators can be difficult to attain as the resonators suffer from physical (related to the geometry of the structure of the resonator) and technical (limited to manufacturing tolerances) limitations.

The present invention has been devised with the foregoing in mind.

SUMMARY OF THE INVENTION

A first aspect of the invention provides a filtering circuit comprising at least two slot line resonators arranged side by side on a dielectric substrate having a first surface provided with a conductive layer and a second parallel surface, each of said at least two resonators comprising a slot line etched in the conductive layer and folded according to a spiral pattern having a plurality of turns, with a shape factor such that the slot line has parts noticeably parallel or concentric, wherein at least one turn of the spiral pattern of each of the resonators comprises at least one discontinuity, the discontinuities of said at least two slot line resonators being arranged in such a manner as to increase the electromagnetic coupling between said at least two slot line resonators.

The two slot line resonators have adjacent edges for electromagnetic coupling each slot line comprising a coupled portion at the respective adjacent edge and at least one uncoupled portion, opposite the adjacent edge. An uncoupled portion is parallel to and spaced apart from the adjacent edge. The said at least one discontinuity of the turn of the spiral pattern may be provided in said uncoupled portion of the slot line.

According to embodiments of the invention, coupling between two resonators may be increased by creating discontinuities in the spiral pattern of the resonators.

The increase in the level of electromagnetic coupling between the resonators can reduce the transmission losses of the filter.

According to a particular embodiment, the filtering circuit comprises two slot line resonators and the spiral patterns of said two slot line resonators are noticeably identical, one of said spiral patterns being pivoted by 180° in relation to the other of said spiral patterns.

This configuration of spiral patterns can provide a strong level of electrical field in the adjacent parts of the two spiral patterns.

According to a particular embodiment, the spiral patterns of said two slot line resonators have adjacent edges by which the electromagnetic coupling is realised and each spiral pattern comprises a portion, called coupled, contiguous to the adjacent edge and at least one other portion, called uncoupled, contiguous to the edge opposite the adjacent edge, said at least one discontinuity of the turn of the spiral pattern is present in said uncoupled portion of the spiral pattern.

According to a particular embodiment, the spiral patterns of said at least two slot line resonators are arranged such that, when the slot line resonators are excited, the highest electrical field values are present in said coupled portions and in that the electrical fields in said coupled portions are in phase (have the same direction).

According to a particular embodiment, each turn of the spiral patterns comprises a discontinuity.

According to a particular embodiment, the discontinuities of the spiral patterns are aligned on an axis linking the centres of the spiral patterns.

According to a particular embodiment, the spiral patterns have a general rectangular or square shape.

According to a particular embodiment, the spiral patterns comprise at least three turns.

According to a particular embodiment at least one supply structure is realised on the substrate to supply the slot line of the input and output resonators. For example, the at least one supply structure can be realised on the second face of the substrate.

According to a particular embodiment, the supply structure is realised on the second face of the substrate and comprises a patch located under the spiral pattern, said patch is linked to the slot line by a via through the dielectric substrate.

According to a particular embodiment, the via of each slot line resonator is positioned noticeably in the centre of the spiral pattern of the resonator.

Embodiments of the invention propose a filtering circuit comprising at least two slot line resonators coupled and arranged so as to reduce the transmission losses during the filtering.

Embodiments of the invention propose an arrangement of slot line resonators enabling a strong coupling of the resonators to be obtained while arranging them side by side without bringing them too close so as to be able to realise the filter on standard mass production lines and with the low-cost substrate.

Another aspect of the invention relates to a band-pass filter comprising at least one filtering device according to any embodiment of the first aspect of the invention.

A further aspect of the invention relates to an electronic device comprising at least one filtering device according to any embodiment of the first aspect of the invention.

Other advantages may also occur to those skilled in the art upon reading the examples below, illustrated by the annexed figures, given by way of illustration.

DETAILED DESCRIPTION OF THE INVENTION

Figure 1:
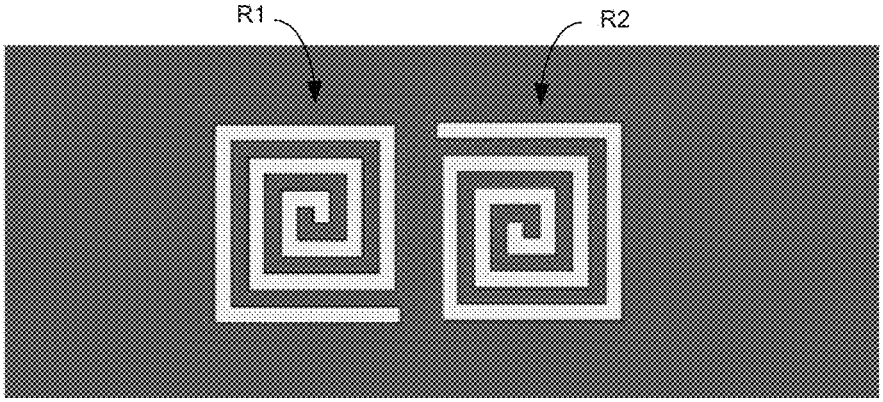
FIG. 1 shows a simplified diagram of a filtering circuit according to the prior art, comprising two slot line resonators folded according to a spiral pattern.

FIG. 1 shows a simplified diagram of two coupled resonators, R1 and R2, that are arranged side by side to form a filter. Each of the two resonators is a spiral slot line resonator as shown diagrammatically in FIGS. 2 to 4. These figures show more particularly the resonator R1. Such a resonator is for example described in the French patent application no. 1450769.

Figure 2:
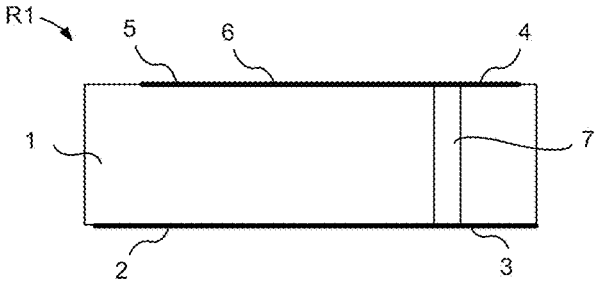
FIG. 2 shows a cross-section view of a slot line resonator of the filtering circuit of FIG. 1, said slot line filter being realised on a dielectric substrate featuring two conductive layers.
Figure 3:
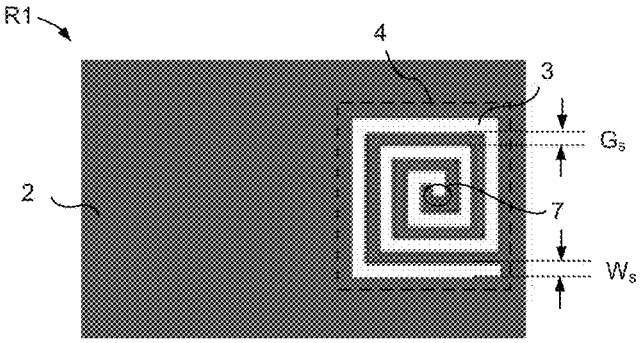
FIG. 3 shows a view of the first conductive layer of the substrate of the resonator of FIG. 2.
Figure 4:
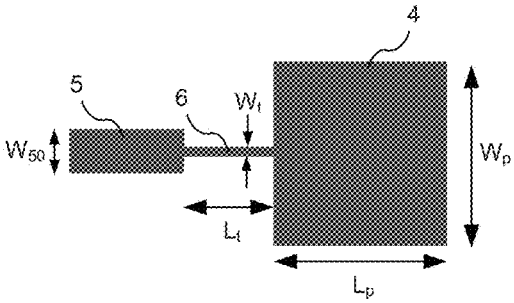
FIG. 4 shows a view of the second conductive layer of the substrate of the resonator of FIG. 2.

The resonator is realised on a dielectric substrate featuring on each of its faces a conductive layer. FIGS. 2 to 4 respectively show a cross-section view of the substrate on which the resonator is realised, a view of the lower face and a view of the upper face of the substrate.

More specifically, a dielectric substrate 1 is equipped on one of its faces with a conductive layer 2 wherein a slot line has been etched in a spiral pattern 3. This slot line has a width Ws and a length L which is a function of the operating frequency of the resonator.

On the face of the substrate opposite the conductive layer 2, a patch 4 made of a conductive layer has been implemented. This patch 4 is non-resonant and participates in feeding the slot line. It has a width Wp and a length Dp and covers the spiral pattern as shown by the dotted line in FIG. 3. Moreover, the slot line 3 is folded in a spiral pattern such that the spacing between two parallel slots is equal to Gs. As shown in FIG. 2, the spiral pattern 3 is interconnected with the patch 4, forming a microstrip line/coplanar waveguide transition by a metal-plated via 7. On the other hand, the patch 4 is connected to a feed line 5 which is in general a line of 50 ohms impedance. The patch 4 is connected to the 50 ohms line 5 via the intermediary of an impedance transformer 6 so that the impedance provided by the patch corresponds to the impedance of the feed line 5.

Table 1 below gives the values used for the lengths and widths of the different elements of the resonator to obtain a resonance at a frequency close to 5 GHz.

TABLE 1

| Parameters | Values |
|---|---|
| Length of the patch $L_p$ | 5.08 mm |
| Width of the patch $W_p$ | 5.08 mm |
| Length of the slot line L | 29.468 mm |
| Width of the slot line $W_s$ | 0.38 mm |
| Space between two adjacent slot lines $G_s$ | 0.38 mm |
| Width of the port at 50 ohms $W_{50}$ | 1.8782 mm |
| Length of the impedance transformer $L_t$ | 8.475 mm |
| Width of the impedance transformer $W_t$ | 0.5 mm |
| Dielectric substrate | Thickness 1 mm<br>$\epsilon_r = 4.6$<br>$\tan\delta = 0.02$ |

In this embodiment, the slot line is folded into a spiral noticeably according to a square shaped pattern and is excited in its centre by the via 7 to the metal patch 4, said patch is supplied by the feed line 5. For the dimensions indicated, the resonator resonates at a frequency of 5.11 GHz.

For the filtering circuit shown in FIG. 1, the feed line of the resonator R1 forms the input of the filter whereas the feed for the resonator R2 forms the output of the filter.

Figure 5:
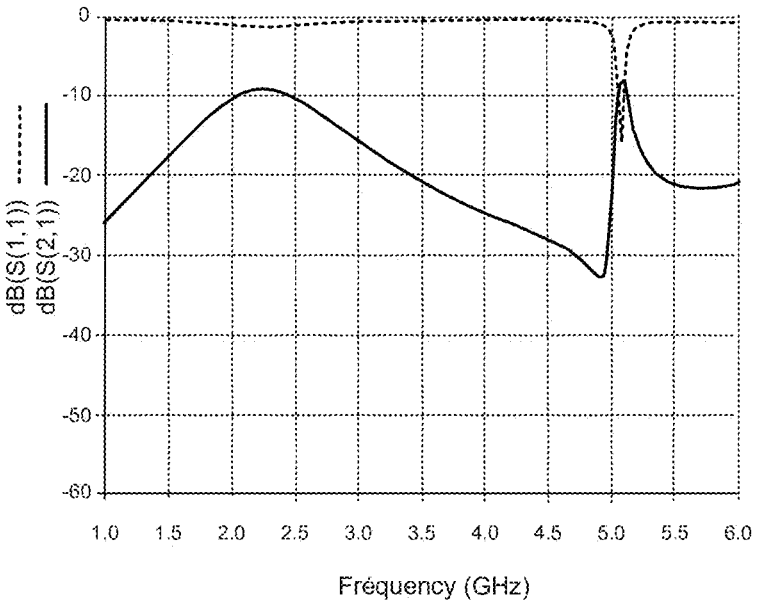
FIG. 5 shows graphs illustrating the response in S of the filtering circuit of FIG. 1.

The response in S of the filter of FIG. 1 comprising two resonators R1 and R2 as defined previously is shown in FIG. 5. S(1,1) shows the insertion losses of the filter and S(2,1) shows the transmission losses of the filter. The central frequency of the filter corresponds to the resonant frequency of the resonators R1 and R2, that is 5.11 GHz. The transmission losses of this filter are too high, in the order of −8 dB. An increase in the coupling between the two resonators thus seems necessary to improve the response in S of the filter.

Figure 6:
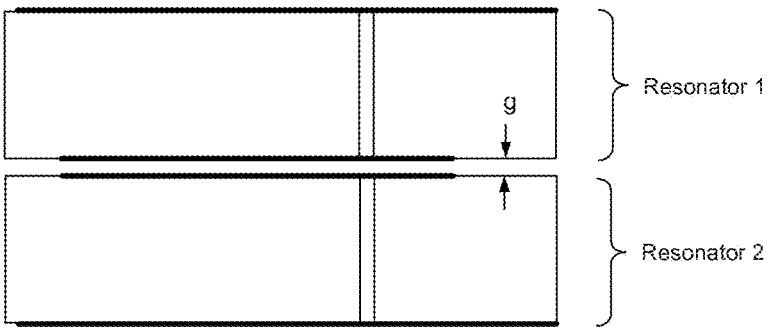
FIG. 6 shows a cross-section view of a filtering circuit in which the slot line resonators are stacked.

It may be noted that more complex coupling structures such as resonators stacked on each other in a multilayer structure, as shown diagrammatically in FIG. 6, have been developed but, to obtain a strong coupling between the resonators, the distance g separating the two resonators must be very small, in the order of 0.1 mm, which cannot be realised easily with a standard low-cost substrate in a mass production line. Moreover, such a structure with stacking of resonators on a standard FR4 substrate with 4 layers limits the number of stacked resonators to two.

Figure 7:
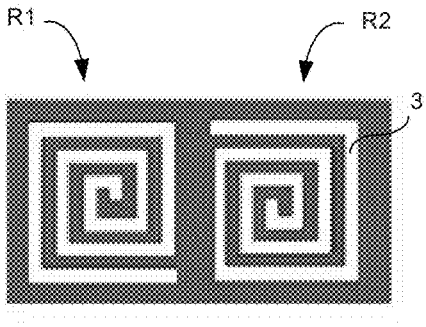
FIG. 7 illustrates a diagram of the spiral pattern of the slot line resonators of the prior art.
Figure 8:
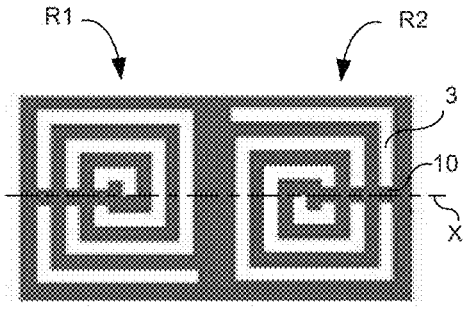
FIG. 8 illustrates a diagram of the spiral pattern of the slot line resonators according to a first embodiment of the invention, the turns of each of the spiral patterns comprising a discontinuity.

According to embodiments of the invention, instead of trying to bring as close together as possible the adjacent edges of the two slot line resonators (with the limitations mentioned in the preamble of this patent application), it is proposed to increase the electromagnetic coupling between the two resonators by creating discontinuities 10 in the spiral pattern of the slot line 3 as shown in FIG. 8, to be compared with FIG. 7 illustrating the prior art (absence of discontinuities).

Figure 9:
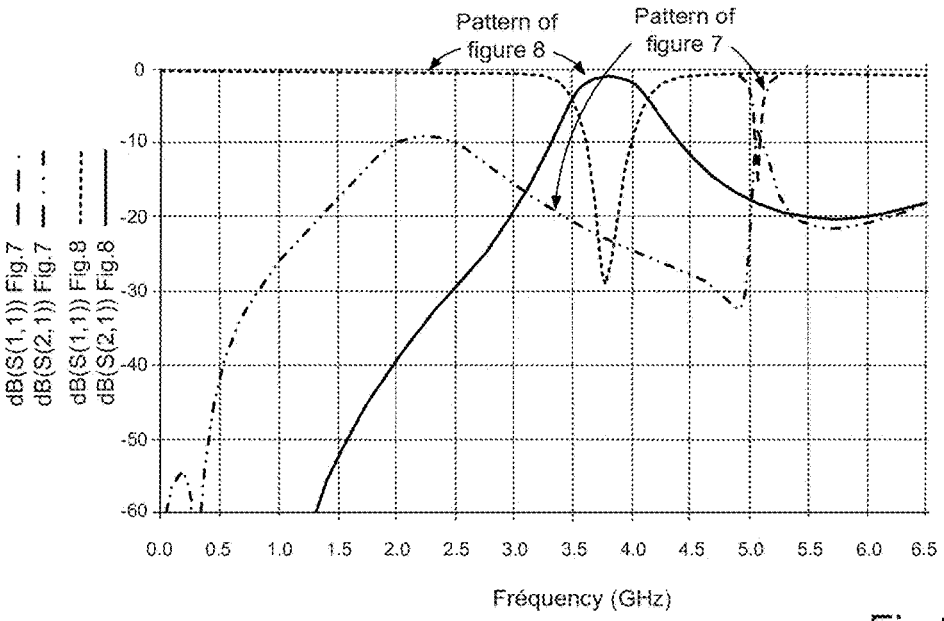
FIG. 9 shows the graphs illustrating the response in S of the filtering circuit using the pattern of FIG. 8 in relation to that of the filtering circuit using the pattern of FIG. 7.

These discontinuities in the slot line are referenced 10 in FIG. 8. The spiral pattern 3 being etched in the conductive layer 2, the latter is kept at the level of the discontinuities 10. Simulations have shown that the effect of these discontinuities is to strongly increase the electromagnetic coupling between the two resonators R1 and R2 and to increase the central frequency of the filter as this is illustrated by the diagrams of FIG. 9. The increase of the coupling level between the two resonators can significantly reduce the level of the transmission losses S(2.1) of the filter. With the configuration proposed in FIG. 8, the transmission losses are of the order of −0.8 dB, to compare with the −8 dB in the absence of discontinuities. The central frequency of the filter is of the order of 3.8 GHz instead of 5.11 GHz without the discontinuities.

Figure 10:
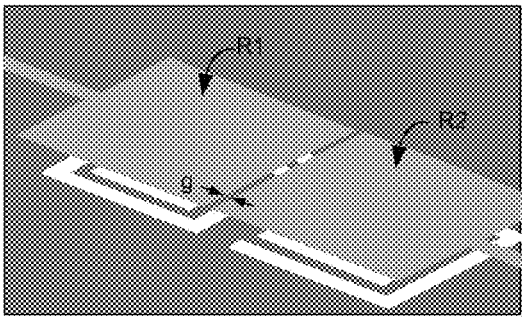
FIG. 10 is a perspective view of the filtering circuit according to the invention showing the distance g between the patches of the slot line resonators.

In the remainder of the description, embodiments of the invention will be described in a more detailed manner through different embodiments and the phenomena used in the invention will be explained. In all the embodiments described below, the filter comprises two slot line resonators R1 and R2 separated by a distance g equal to 0.2 mm as shown in FIG. 10. The distance g is the distance between the adjacent edges of the patches of the two resonators.

Figure 11:
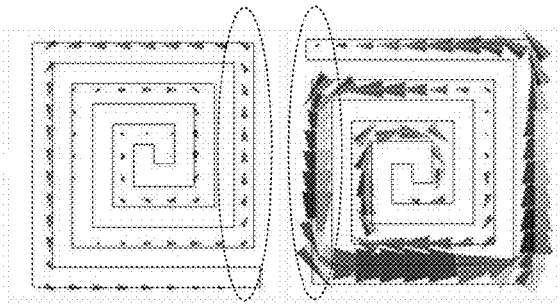
FIG. 11 diagrammatically shows the electrical field intensity along the slot line of the spiral patterns of FIG. 7 of the prior art.

The operation of the pass-band filter of FIG. 1 and of FIG. 7 (prior art) is first of all explained. This filter in which the slot line resonators are arranged side by side has significant transmission losses, of the order of −8 dB at the central frequency of the filter. This means that the resonators are unable to be sufficiently coupled to their resonant frequencies, this weak coupling only enables the transmission of a small part of the signal in the bandwidth of the filter. FIG. 11 illustrates the intensity and the phase (direction) of the electrical field along the slot line of the two resonators in operating conditions. The electrical field is represented by isosceles triangles of which the size is proportional to the intensity of the electrical field and of which the point opposite the base indicates the phase (direction) of the electrical field.

FIG. 11 shows that the electrical fields in the slot line portions of the two resonators R1 and R2 that are adjacent are in phase opposition, which partly explains their weak coupling. These adjacent line portions are the slot line portions present within the dotted line ellipses in FIG. 11.

Figure 12:
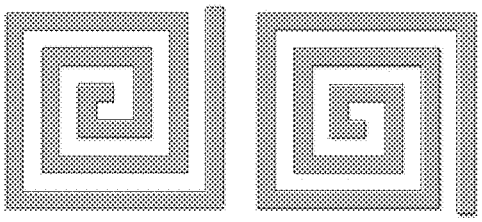
FIG. 12 shows another configuration of spiral patterns.
Figure 13:
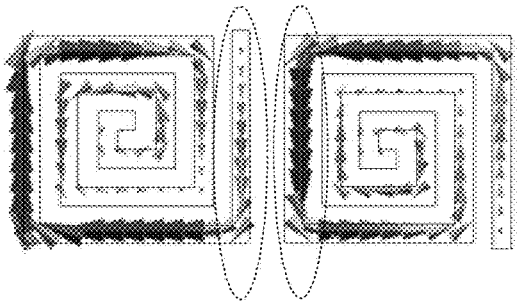
FIG. 13 diagrammatically shows the electrical field intensity along the slot line of the spiral patterns of FIG. 12.
Figure 14:
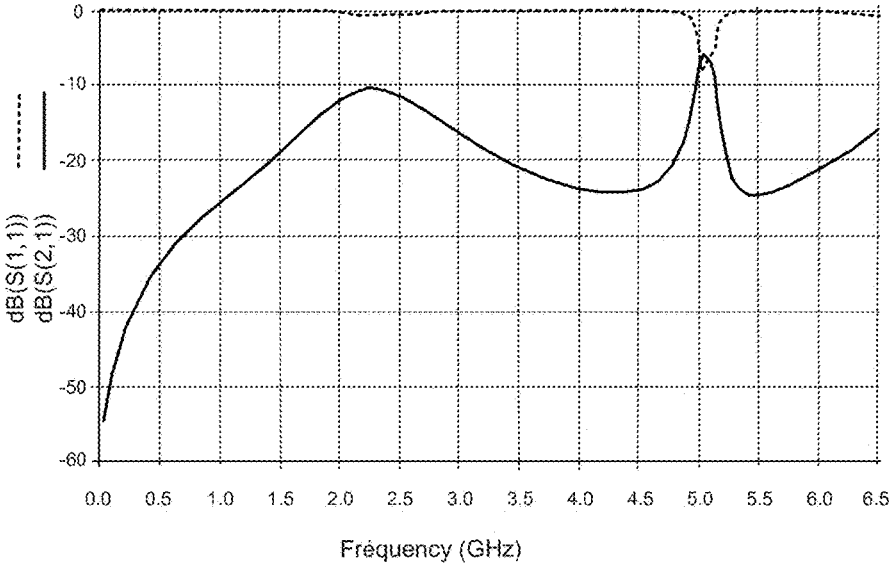
FIG. 14 shows graphs illustrating the response in S of the filtering circuit using the pattern of FIG. 13.

A second configuration of the spiral patterns is proposed in FIG. 12. The purpose of this new configuration is to put into phase (in the same direction) the electrical fields in the line portions adjacent to the two resonators R1 and R2. FIG. 13 shows the intensity and the direction of the electrical field along the slot line of the two resonators in operating conditions with this configuration. FIG. 14 illustrates the response in S (parameters S(i,j)) of the filter with this configuration. Despite the marginal improvement of the parameter S(2.1) that goes from −8 dB to −6.2 dB, the transmission losses in the bandwidth still remain very high. This is due to the fact that, for one of the two spiral patterns (that of the left-hand resonator), the maximum electrical field is not set up on the coupled portion of the resonator, thus reducing the transfer of power between the two resonators.

As can be seen, it is relatively difficult to realise the electromagnetic coupling between the two spiral slot line resonators. The transmission losses created make them practically unusable in the real world.

To resolve this problem, it was observed that the introduction of discontinuities in the turns of the spiral pattern portion in the uncoupled portion of the two spiral patterns associated with a particular configuration of the spiral patterns was able to significantly increase the coupling between the two slot line resonators, as shown in the FIG. 8. The coupled portion of a pattern designates the contiguous pattern portion on the edge of the pattern that is adjacent to the other pattern. The uncoupled portion of a pattern designates the contiguous pattern portion on the opposite edge of the adjacent pattern.

Figure 15:
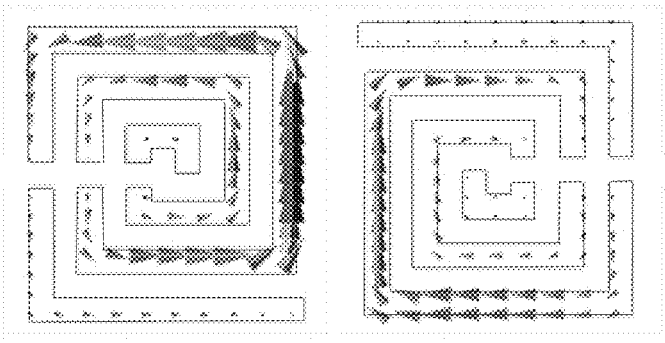
FIG. 15 diagrammatically shows the electrical field intensity along the slot line of the spiral patterns of FIG. 8.

FIG. 15 shows the intensity and the phase of the electrical field along the slot line of the two resonators in operating conditions in this configuration. It is noted that, in this configuration, that, on the coupled portions of the spiral patterns, the electrical field is maximum and is in phase. The result is the low transmission losses of the order of −0.8 dB, as illustrated in FIG. 9.

The low transmission losses observed are obtained thanks to the two simultaneous conditions mentioned above that are reached thanks to the presence of discontinuities and the configuration of the spiral patterns:

- the electrical fields in the coupled portions of the two resonators are maximum;
- the electrical fields in the coupled portions of the two resonators are in phase (that have the same direction).

Note that the presence of discontinuities lowers the resonant frequency, which contributes to the miniaturization of the circuit. A possible explanation of this phenomenon is that the discontinuities act as capacitive/inductive elements to lower the effective resonant frequency of the resonator.

Figure 16:
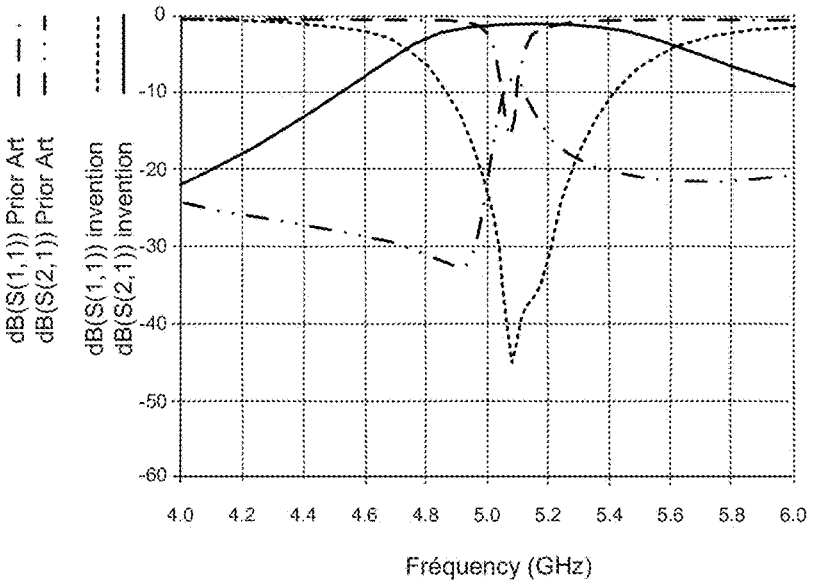
FIG. 16 shows the graphs illustrating the response in S of the filtering circuit using the pattern of FIG. 8 after resizing of the elements of the latter so that the central frequency of the filter is around 5 GHz.

If the resonators are resized to obtain a band-pass filter at 5 GHz, the filter response illustrated by the diagram of FIG. 16 is obtained.

The transmission losses (S(2,1)) are in the order of −0.8 dB with embodiments of the invention. Also, an excellent impedance matching of the filter can be observed with S(1.1)<−20 dB on a band of 300 MHz around the central frequency of 5.15 GHz.

In the embodiment illustrated by FIG. 8, each turn of the spiral pattern comprises a discontinuity. These discontinuities are present in the uncoupled portion of the pattern. These discontinuities are moreover arranged on an axis X linking the centres of two spiral patterns. In this embodiment, the discontinuities are therefore aligned.

Figure 17:
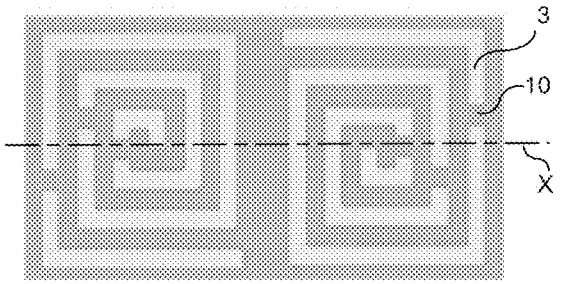
FIG. 17 illustrates a diagram of the spiral pattern of the slot line resonators according to a second embodiment of the invention.
Figure 18:
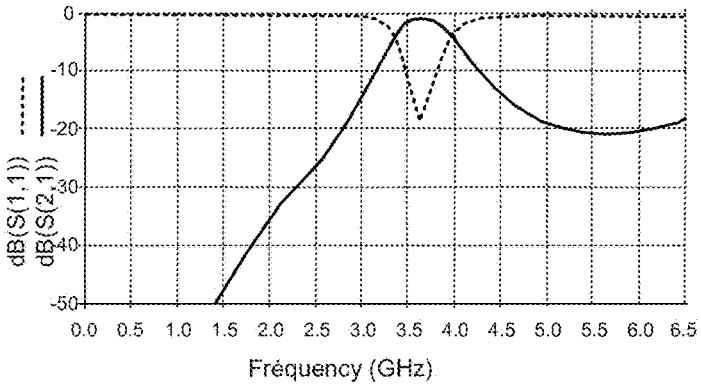
FIG. 18 shows graphs illustrating the response in S of the filtering circuit using the pattern of FIG. 17.

According to another embodiment illustrated by FIG. 17, the discontinuities are no longer aligned on the X axis but arranged, for at least one of them, above or below this axis. The spiral pattern comprising 3 turns, one of the discontinuities is positioned on the X axis and the other two discontinuities are positioned respectively above and below the X axis. The results of this filter, illustrated by FIG. 18, show that the response in S of this filter varies little in relation to the case where the discontinuities are positioned on the X axis.

Figure 19:
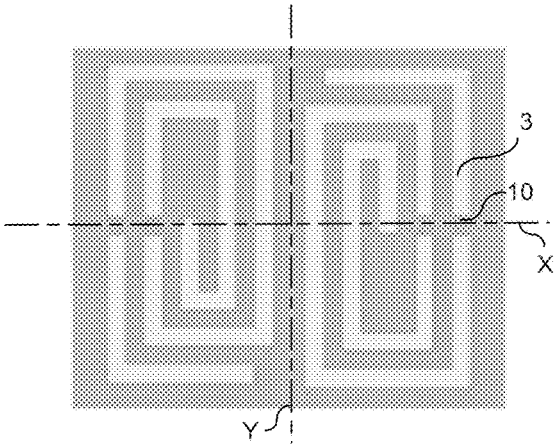
FIG. 19 illustrates a diagram of the spiral pattern of the slot line resonators according to a third embodiment of the invention.
Figure 20:
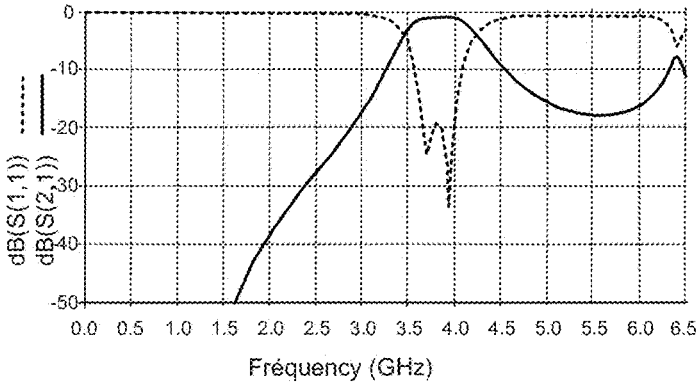
FIG. 20 shows graphs illustrating the response in S of the filtering circuit using the pattern of FIG. 19.

In the embodiments described previously, the general shape of the turns of the spiral pattern is noticeably square. According to a particular embodiment, it is proposed to modify this shape factor. FIG. 19 illustrates the case of spiral patterns whose dimensions have been reduced in width (on the X axis) and increased in height (on a Y axis perpendicular to the X axis) to obtain turns of a general rectangular shape. In the example of FIG. 19, a factor of 0.8 was applied to the dimensions of the turns on the X axis and a factor of 1.2 was applied to the dimensions of the turns on the Y axis so as to keep the length L of the slot line. The width of the slot line Ws and the space Gs between the slot line adjacent portions were also conserved. The results illustrated by FIG. 20 also show that this configuration is also extremely effective: S(2.1)=−0.77 dB at the frequency of 3.8 GHz. The transmission losses S(2.1) are still reduced owing to the increase in the length of the slot line portions opposite. This works to strengthen the coupling between the two resonators.

Figure 21:
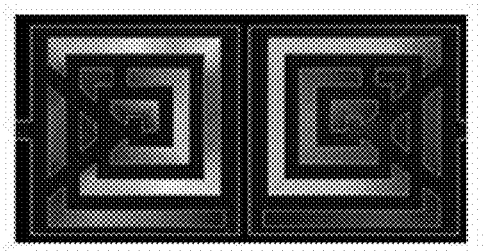
FIG. 21 illustrates a diagram of the spiral pattern of the slot line resonators according to a fourth embodiment of the invention.
Figure 22:
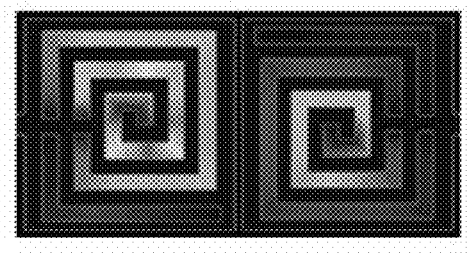
FIG. 22 illustrates a diagram of the spiral pattern of the slot line resonators according to a fifth embodiment of the invention.

According to other embodiments, the turns of the spiral pattern comprise more than one discontinuity per turn as illustrated by FIG. 21 or else a part of the turns does not have a discontinuity as illustrated by FIG. 22. Simulations have shown that these modifications lead to variations in the response in S of the filters while, however, conserving lower transmission losses than in the prior art.

The embodiments described above have been provided as examples. It is evident to those skilled in the art that they can be modified, notably regarding the shape of the spiral patterns, their dimensions, their number of turns, the number of discontinuities per turn and the position of the discontinuities.

With regard to what has preceded, it can be considered that the embodiments of the invention procure the following advantages:

- transmission losses close to zero in the bandwidth of the filter;
- reduction in size of the filter;
- simplicity of manufacture with standard mass production lines and low manufacturing cost.

The invention claimed is:

1. A filtering circuit comprising at least two slot line resonators arranged side by side on a substrate a first face provided with a conductive layer and a second parallel face, each of said at least two slot line resonators comprising a slot line provided in the conductive layer and folded according to a spiral pattern having a plurality of turns, with a shape factor such that the slot line has parallel or concentric parts, wherein said at least one turn of the spiral pattern of each of the slot line resonators comprises at least one discontinuity, the two slot line resonators having adjacent edges for electromagnetic coupling, each of the slot line resonators comprising a coupled portion at the respective adjacent edge and an uncoupled portion opposite the adjacent edge, said at least one discontinuity of the turn of the spiral pattern being provided in said uncoupled portion of the respective slot line resonator.

2. The filtering circuit according to claim 1, wherein the spiral patterns of said at least two slot line resonators are noticeably identical, one of said spiral patterns being rotated by 180° with respect to the other of said spiral patterns.

3. The filtering circuit according to claim 1, wherein electric fields at the coupled portions of the slots lines are in phase.

4. The filtering circuit according to claim 1, wherein the spiral patterns of said at least two slot line resonators are arranged such that, when the slot line resonators are excited, highest electrical field values are present in said coupled portions.

5. The filtering circuit according to claim 1, wherein each of said turns of the spiral patterns of the non coupled portion comprises a discontinuity.

6. The filtering circuit according to claim 5, wherein the discontinuities of the spiral patterns are aligned on an axis linking a center of the spiral patterns.

7. The filtering circuit according to according to claim 1, wherein the spiral patterns have a general rectangular or square shape.

8. The filtering circuit according to claim 1, wherein the spiral patterns comprise at least three turns.

9. The filtering circuit according to claim 1 wherein at least one supply structure is provided on the substrate to supply the slot line of input and output resonators of the filtering circuit.

10. The filtering circuit according to claim 9, wherein the supply structure is provided on the second face of the substrate and comprises a patch located under the spiral pattern, said patch is linked to the slot line by a via through the dielectric substrate.

11. The filtering circuit according to claim 10, wherein the via of each of the slot line resonators is positioned noticeably in a center of the spiral pattern of the resonator.

12. A band-pass filter comprising at least one filtering device according to claim 1.

13. An electronic device comprising at least one filtering device according to claim 1.

* * * * *